US005405455A

United States Patent [19]

Kusunoki et al.

[11] Patent Number: 5,405,455

[45] Date of Patent: Apr. 11, 1995

[54] RARE EARTH-BASED PERMANENT MAGNET

[75] Inventors: Matou Kusunoki; Takehisa Minowa; Masao Yoshikawa, all of Fukui, Japan

[73] Assignee: Shin-Etsu Chemical Co. Ltd., Tokyo, Japan

[21] Appl. No.: 119,641

[22] Filed: Sep. 13, 1993

Related U.S. Application Data

[63] Continuation-in-part of Ser. No. 894,354, Apr. 6, 1992, abandoned.

[30] Foreign Application Priority Data

Jun. 4, 1991 [JP] Japan ..... 3-159765
Jun. 4, 1991 [JP] Japan ..... 3-159766
Jul. 12, 1991 [JP] Japan ..... 3-198476

[51] Int. Cl.[6] ..... H01F 1/057
[52] U.S. Cl. ..... 148/103; 419/12
[58] Field of Search ..... 148/103, 104; 419/12

[56] References Cited

U.S. PATENT DOCUMENTS 4,898,625 2/1990 Otsuka et al. ..... 148/101
4,968,347 11/1990 Ramesh et al. ..... 419/12
5,049,203 9/1991 Rukai et al. ..... 148/101

FOREIGN PATENT DOCUMENTS 0421488 9/1991 European Pat. Off. .
WO-A-9106107 2/1991 WIPO .

OTHER PUBLICATIONS

J. F. Liu et al., 'Magnetic Properties of Ga Doped NdFeCoB Sintered Magnets', *table 1*, IEEE Transactions of Magnetics, vol. 26, No. 5, Sep. 1990, New York US, pp. 2640–2642.

Patent Abstracts of Japan, vol. 12, No. 379 (E-667)(3226) 11 Oct. 1988 & JP-63 127 505 (Taio Yuden Co., Ltd.) 31 May 1988 *abstract*.

*Primary Examiner*—John P. Sheehan
*Attorney, Agent, or Firm*—Wenderoth, Lind & Ponack

[57] ABSTRACT

Disclosed is a novel method for the preparation of a rare earth-based permanent magnet by the so-called two-alloy process in which powders of two kinds of rare earth-containing magnetic alloys each having a different composition from the other are blended together in a specified proportion and the powder blend is shaped in a magnetic field into a green body which is sintered. In the invention, the first magnetic alloy has a composition of the formula $R_2T_{14}B$, in which R is a rare earth element selected from the group consisting of neodymium, praseodymium, dysprosium and terbium and T is iron or a combination of iron and cobalt, while the second alloy has a composition of the formula $R_aFe_bCo_cB_dM_e$, in which R has the same meaning as defined above, M is an element selected from the group consisting of gallium, aluminum, copper, zinc, indium, silicon, phosphorus, sulfur, titanium, vanadium, chromium, manganese, germanium, zirconium, niobium, molybdenum, palladium, silver, cadmium, tin, antimony, hafnium, tantalum and tungsten, the subscript a is a positive number in the range from 15 to 40, b is zero or a positive number not exceeding 80, c is a positive number in the range from 5 to 85, d is a positive number not exceeding 20 and e is zero or a positive number not exceeding 20 with the proviso that a+b+c+d+e is 100, and the powders are blended in a weight proportion of 99:1 to 70:30.

6 Claims, No Drawings

RARE EARTH-BASED PERMANENT MAGNET

BACKGROUND OF THE INVENTION

This is a continuation-in-part application from a U.S. patent application Ser. No. 07/894,354 filed Apr. 6, 1992 now abandoned.

The present invention relates to a novel rare earth-based permanent magnet or, more particularly, to a rare earth-based permanent magnet having remarkably improved magnetic properties such as the residual magnetic flux density, coercive force, maximum energy produuct and the like, which can be prepared by a novel and very unique method.

Several types of rare earth-based permanent magnets are known in the prior art and widely used in practical applications by virtue of their very excellent magnetic properties as compared with other non-rare earth permanent magnets. Among the various types of the rare earth-based permanent magnets, those prepared from a ternary alloy of neodymium, iron and boron are highlighted and their application fields are expanding in recent years because they can be manufactured at a relatively low cost owing to the abundance of neodymium among the rare earth elements and omission of expensive cobalt, which is a principal constituent in the samarium-cobalt magnets developed in the early stage of the history of rare earth-based permanent magnets, while they still have excellent magnetic properties comparable with or even better than the magnetic properties of other types of rare earth-based permanent magnets. Extensive investigations have been undertaken and many proposals and attempts have been made for the improvement of the magnetic properties and stability of these neodymium-iron-boron based permanent magnets. For example, an excellent neodymium-iron-boron permanent magnet can be produced by the so-called two-alloy method in which, instead of the conventional powder-metallurgical method using a powder of the single alloy having the same composition as the magnet, two alloys having different compositions are prepared and the fine powders obtained by separately pulverizing the two alloys are mixed together in a specified proportion to give a powder mixture which is molded into a shape of the desired magnet in a magnetic field followed by sintering. The permanent magnet prepared by this two-alloy method sometimes has much better magnetic properties than the magnets prepared by the single-alloy method even when the overall chemical compositions of the magnets are the same.

The above mentioned two-alloy method can be classified into three types depending on the procedure by which the alloy powders before blending are prepared. In the method of the first type disclosed, for example, in Japanese Patent Kokai 63-93841, 63-252403, 63-278308, 1-108707, 1-146310, 1-146309 and 1-155603, either one or both of the two alloys are prepared by the so-called liquid-quenching method so that the alloy thus produced can be an amorphous or microcrystalline alloy. It is recently reported by E. Otuki, et al. in Eleventh International Workshop on Rare Earth Magnets, Pittsburgh, Pa., October 1990, page 328 that the rare earth-based permanent magnet prepared by using this liquid-quenching method may have an extremely high maximum energy product of 50 MGOe or even higher.

In the second-type method disclosed in Japanese Patent Kokai 61-81603, 61-81504, 61-71605, 61-81606, 61-81607, 61-119007, 61-207546, 63-245903 and 1-177335, two different alloys of a rare earth element R each having a chemical composition of the formula $R_2Fe_{14}B$ as an intermetallic compound are prepared by modifying the kind and content of the rare earth element or elements, one being rich and the other being lean in the content of neodymium.

In the third-type method disclosed in Japanese Patent Kokai 60-230959, 61-263201, 62-181402, 62-182248, 62-206802, 62-70746, 63-6808, 63-104406, 63-114939, 63-272006, 1-111843 and 1-146308, one of the alloy powders having a chemical composition of the formula $R_2Fe_{14}B$, in which R is mainly neodymium, is mixed with a second powder prepared from a certain element or alloy of a low melting point or carbide, boride, hydride and the like of a rare earth element followed by the powder metallurgical process for the preparation of a magnet.

The above described two-alloy methods of the prior art have their respective advantages and disadvantages so that none of these prior art methods are quite satisfactory from the practical standpoint of view. For example, the first-type method disclosed by Otuki has a problem that the coercive force of the permanent magnet obtained thereby cannot be high enough to rarely exceed 9 kOe, which is subject to a decrease as the temperature is increased, although a considerably large value of the maximum energy product can be obtained by the method.

Even when the problem relative to the low coercive force can somehow be solved at least at room temperature, a serious problem inherent in the liquid-quenching method is the poor susceptibility of the alloy particles to magnetic orientation because, as is mentioned above, the particles as prepared by the liquid-quenching method have an amorphous or microcrystalline structure exhibiting no magnetic anisotropy so that the otherwise effective molding method of the powder in a magnetic field is little effective to effect magnetic orientation of such non-anisotropic particles.

In the second-type method, an alloy phase rich in the content of neodymium and a phase having a formula of $Nd_{1+x}Fe_4B_4$ coexist with the $R_2Fe_{14}B$ compound in the magnetic alloy while these two phases are both non-magnetic at room temperature. Accordingly, the magnetic orientation of magnetic particles is greatly disturbed by the presence of such non-magnetic particles so that the magnetic properties of the thus prepared permanent magnet cannot be fully improved. This situation of disturbed magnetic orientation is similar also in the third-type method because the additive powder is also non-magnetic to cause an increase in the demagnetizing field with a consequent decrease in the effective strength of the magnetic field so as not to give full orientation of the magnetic particles along the direction of the magnetic field.

The third-type method using a low melting-point powder is based on an idea that the particles of the low melting-point phase in the powder mixture may have an effect of removing the nucleation sites, such as the lattice defects and the oxide phase, found on the grain boundary of the $R_2Fe_{14}B$ compound during sintering to have an effect of cleaning of the grain boundaries leading to an increase in the coercive force. Presence of such a low melting-point phase in the powder mixture, however, is an adverse condition against improvement of the magnetic properties of the permanent magnets to cancel the advantage. When the low melting-point phase has a melting point of, for example, around 660° C., the melt of this phase would have a considerably decreased viscosity at the temperature of sintering which is conducted usually at about 1100° C. so that the magnetic particles which have been oriented in the molding process in a magnetic field may float in the low-viscosity melt to cause random rotation resulting in shuffling of once magnetically oriented particles in the course of sintering which proceeds by the liquid-phase sintering to effect shrinkage of the molded body. In other words, it is important in the liquid-phase sintering of the neodymium-based magnet that the melt of the low melting-point phase in the sintering process has a viscosity high enough not to allow free rotation of the magnetic particles but low enough to give a fully densified structure of the sintered body with a full cleaning effect of the grain boundaries.

In short, the two-alloy methods of the prior art, so to say, have been established without detailed consideration of the balance between the magnetic orientation of the magnetic particles to which the liquid-phase constituent of the mixture pertains and the improvement in the coercive force of the magnet leading to adjustment of the magnetic properties and the melting point of the low melting-point phase to optimize the balance above mentioned.

SUMMARY OF THE INVENTION

The present invention accordingly has an object to provide a novel method capable of giving a rare earth-based permanent magnet having well-balanced magnetic properties prepared by the two-alloy method which, however, has been established after a fundamental reconsideration of the above discussed problems in the prior art two-alloy methods relative to the composition of each of the alloy powders and the procedures for the preparation thereof.

Thus, the method for the preparation of a rare earth-based permanent magnet provided by the invention comprises the steps of:

(a1) melting together, at a temperature of 1000° C. or higher in an inert atmosphere, a rare earth metal, metallic iron, optionally, in combination with metallic cobalt and elementary boron in such a proportion represented by the formula $$R_2T_{14}B, \quad (I)$$

in which R is a rare earth element which preferably is selected from the group consisting of neodymium, praseodymium, dysprosium and terbium and T is iron or a combination of iron and cobalt in such a proportion that the amount of cobalt does not exceed 40% by weight of the total amount of iron and cobalt, to form a melt of a first magnetic alloy;

(b1) cooling the melt of the first magnetic alloy in a casting mold at a rate of temperature decrease not exceeding 850° C. per minute but not lower than 1° C. per minute at least until the temperature of the melt reaches 200° C. to form an ingot of the first magnetic alloy;

(a2) melting together, at a temperature of 1000° C. or higher in an inert atmosphere, metals of a rare earth element, iron and cobalt, elementary boron and an elementary form of an element M defined below in such a proportion represented by the formula $$R_aFe_bCo_cB_dM_e, \quad (II)$$

in which R has the same meaning as defined above, M is an element selected from the group consisting of gallium, aluminum, copper, zinc, indium, silicon, phosphorus, sulfur, titanium, vanadium, chromium, manganese, germanium, zirconium, niobium, molybdenum, palladium, silver, cadmium, tin, antimony, hafnium, tantalum and tungsten, the subscript a is a positive number in the range from 15 to 40, b is zero or a positive number not exceeding 80, c is a positive number in the range from 5 to 85, d is a positive number not exceeding 20 and e is zero or a positive number not exceeding 20 with the proviso that a+b+c+d+e is 100, to form a melt of a second magnetic alloy;

(b2) cooling the melt of the second magnetic alloy in a casting mold at a rate of temperature decrease not exceeding 850° C. per minute at least until the temperature of the melt reaches 200° C. to form an ingot of the second magnetic alloy;

(c) crushing and pulverizing the ingots of the first and second magnetic alloys either together or separately in an inert atmosphere into particles having an average particle diameter in the range from 1 to 20 μm;

(d) uniformly mixing the particles of the first and second magnetic alloys in a weight proportion in the range from 99:1 to 70:30 in an inert atmosphere;

(e) shaping the powder mixture into a powder compact having a form of a magnet by compression molding in a magnetic field;

(f) sintering the shaped form of the powder compact by heating in vacuum or in an atmosphere of an inert gas at a temperature in the range from 900° C. to 1250° C. for for a length of time in the range from 30 minutes to 10 hours; and (g) subjecting the sintered body to an aging treatment at a temperature not exceeding 900° C. for at least 30 minutes.

The second magnetic alloy powder is characterized by the unique metallographic structure including, besides the $R_2T_{14}B$ phase, at least one of the phases having a chemical composition of the formulas $RT_4L$, $RT_3$, $RT_2$, $R_2T_7$ and $RT_5$, in which R and T each have the same meaning as defined above and L is boron or a combination of boron and the element M, e.g., gallium.

DETAILED DESCRIPTION OF THE PREFERRED EMBODIMENTS

As is described above, the method for the preparation of a rare earth-based permanent magnet according to the invention is the so-called two-alloy method in which powders of two kinds of magnetic alloys having specified but different compositions are mixed together in a specified weight proportion and the powder mixture is subjected to shaping by molding in a magnetic field to give a green body which is sintered by heating in vacuum or in an atmosphere of an inert gas such as argon followed, usually, by an aging treatment at a temperature substantially lower than the sintering temperature.

The first of the two magnetic alloys, referred to as the Alloy I hereinafter, is basically a ternary alloy mainly consisting of the metallographic phase expressed by the formula $R_2T_{14}B$. In this formula, R is a rare earth element including yttrium but preferably selected from the group consisting of neodymium, praseodymium, dysprosium and terbium although a limited portion thereof can be replaced with other rare earth elements including yttrium and the elements having an atomic number in the range from 57 to 71 inclusive. T in the formula is iron or a combination of at least 60% by weight of iron and 40% by weight or less of cobalt. Although cobalt is an optional ingredient, the amount thereof in the combination of iron and cobalt, when added, should be at least 0.1% by weight or, preferably, at least 1% by weight in order that the advantage obtained by the combined use of cobalt can be fully exhibited. Namely, addition of cobalt to the Alloy I is effective in increasing the Curie point of the alloy and also increasing the corrosion resistance of the magnet.

The Alloy I is prepared by melting together each a specified and weighed amount of the respective ingredients R, i.e. one or more of the rare earth elements, T, i.e. iron or iron and cobalt, and boron each in a metallic or elementary form in vacuum or in an atmosphere of an inert gas which is preferably argon. It is optional to use a ferroboron as the source material of boron and a part of the iron source in combination with an appropriate amount of elementary iron or boron to adjust the iron to boron ratio depending on the composition of the ferroboron. Although the above mentioned source materials of the respective ingredients shoud have a purity as high as possible, small amounts of impurities usually unavoidable in industrial production of the materials may have no particular adverse influences. The melt of the alloy is cast in a metal mold and cooled at a cooling rate not exceeding 850° C. per minute at least until the temperature of the solidified ingot reaches 200° C. to give an alloy ingot mainly consisting of the phase of $R_2T_{14}B$. Since this phase is formed by the peritective reaction between the incipient phase of $\alpha$-iron and a liquid phase rich in the content of the rare earth element, it would be a possible case that the ingot of the Alloy I contains small amounts of the remaining $\alpha$-iron phase, a phase rich in the content of boron and/or a phase rich in the content of the rare earth element. When the fraction of these extraneous phases are too large, the alloy ingot is subjected to a solution treatment by heating at 700° to 1200° C. for at least 1 hour in vacuum or in an atmosphere of an inert gas so as to convert these phases into the phase of $R_2T_{14}B$, the fraction of which should desirably be as large as possible.

The ingot of the Alloy I obtained in the above described manner is finely pulverized either by a wet process or dry process using a suitable pulverizing machine. Namely, the ingot is first crushed into coarse particles which are then finely pulverized. It is essential in each method of pulverization that surface oxidation of the alloy particles, which is highly reactive with atmospheric oxygen, should be avoided as far as possible. For example, the wet-process pulverization is performed in a non-reactive organic solvent such as fluorinated hydrocarbon solvents and the dry-process pulverization is performed in an atmosphere of an inert gas such as nitrogen. When fine pulverization of the coarse particles is conducted by using a jet mill, nitrogen is used as the jet gas. The powder of the Alloy I shoud have an average particle diameter in the range from 1 to 20 $\mu$m or, preferably, in the range from 1 to 10 $\mu$m. When the average particle diameter of the particles is too large, the powder mixture of the two magnetic alloys cannot be sintered to effect full densification while the average particle diameter should not be too small because a too fine powder is highly susceptible to the surface oxidation of the particles by the atmospheric oxygen to cause serious degradation of the magnetic properties of the magnets.

The second of the two magnetic alloys, referred to as the Alloy II hereinafter, is basically a five-component alloy having a composition represented by the formula $R_aFe_bCo_cB_dM_e$, in which R has the same meaning as defined above for the Alloy I and M is an element selected from the group consisting of gallium, aluminum, copper, zinc, indium, silicon, phosphorus, sulfur, titanium, vanadium, chromium, manganese, germanium, zirconium, niobium, molybdenum, palladium, silver, cadmium, tin, antimony, hafnium, tantalum and tungsten or, preferably, gallium.

The subscript a in the formula is a positive number in the range from 15 to 40 or, preferably, from 25 to 35, b is zero or a positive number not exceeding 80 or, preferably, a positive number in the range from 5 to 45, c is a positive number in the range from 5 to 85 or, preferably, in the range from 15 to 65, d is a positive number not exceeding 20 or, preferably, a positive number in the range from 1 to 15 and e is zero or a positive number not exceeding 20 or, preferably, not exceeding 10 with the proviso that the sum of the subscripts a+b+c+d+e is 100. When the value of the subscript a, i.e. the atomic fraction of the rare earth element, is too small, the deficiency in the content of the rare earth element provides no sufficient amount of the liquid phase in the sintering process so that the sintered body cannot be fully densified. When the value of the subscript a is too large, on the other hand, the melting point of the Alloy II would be too low to exhibit the desired effect for the improvement of the magnetic properties of the resulting permanent magnet. When the value of the subscript c, i.e. the atomic fraction of cobalt, is too small, none of the unique metallographic phases of the formulas $RT_4L$, $RT_3$, $RT_2$, $R_2T_7$ and $RT_5$ described before, which can be detected and identified by the combination of the techniques using a scanning electron microscope and electron microprobe analyzer equipped with a wavelength dispersion X-ray spectrometer, could be formed in the Alloy II so that no full improvement can be obtained in the magnetic properties of the permanent magnet. When the value of e, i.e. the atomic fraction of the element denoted by M or, in particular, gallium, is too large, the saturation magnetic flux density of the alloy would be decreased not to impart high magnetic properties to the permanent magnet.

The method for the preparation of an ingot of the Alloy II or a fine powder thereof is not different in principle from that for the preparation of an ingot of the Alloy I or a fine powder thereof described above including the cooling rate of the melt of the alloy which should not exceed 850° C. per minute at least until 200° C. is reached. The requirement for the average particle diameter of the Alloy II powder is also about the same as for the Alloy I powder. It is of course that the liquid-quenching method is applicable also in this case. Namely, the thin belt of the alloy formed by quenching, which is crystallographically amorphous or microcrystalline, formed by the liquid-quenching method is subjected to a heat treatment at a temperature higher than the temperature of crystallization for a certain length of time so as to cause crystallization or growth by recrystallization resulting in the appearance of the characteristic phase or phases.

The metallographic phases contained in the Alloy II include, besides the phase of the formula $R_2T_{14}B$, in which R and T each have the meaning as defined before, and a phase rich in the content of the rare earth element or elements containing at least 35 atomic % of the rare earth element or elements, which were also the constituents of the alloys used in the prior art two-alloy method or the rare earth-boron based magnetic alloys known in the prior art, at least one of the above mentioned five kinds of the unique metallographic phases which appear as an equilibrium phase in the Alloy II as a consequence of the high cobalt content of at least 5 atomic %.

Following are the presumable reasons for the advantages obtained as a consequence of the presence of these unique metallographic phases in the Alloy II. In the first place, it is pointed out that some of these characteristic phases have a Curie point higher than room temperature as a consequence of the content of cobalt. Further, some of these phases each have magnetic crystalline anisotropy in the direction of a particular crystallographic axis. When the powders of the Alloys I and II are mixed together and the powder mixture is brought in a magnetic field for molding, accordingly, a major portion of the particles have magnetic anisotropy resulting in good magnetic orientation of the particles in alignment of the easy-magnetization axis to give excellent magnetic properties of the resulting sintered permanent magnet.

In the second place, it is advantageous that these phases each have a melting point in the range from 700° to 1155° C., which is suitable for the liquid-phase sintering of the neodymium-containing rare earth-based permanent magnet prepared by the method of sintering. Namely, the above mentioned melting point is higher than the melting point of the phase rich in the content of neodymium, i.e. 500° to 650° C., but lower than the melting point of the $R_2Fe_{14}B$ phase which is 1155° C. when R is neodymium. Accordingly, presence of these characteristic phases efficiently avoids the disadvantage that the once aligned particles in the magnetic field is disturbed as a consequence of the too low viscosity of the melt in the absence of these characteristic phases while the melting point thereof is low enough to give a good cleaning effect for the grain boundaries so as to contribute to an increase in the density of the sintered body.

In addition, the relatively high resistance of the Alloy II against oxidation is a consequence of the content of cobalt therein. While otherwise the Alloy II is more susceptible to oxidation than the Alloy I due to the higher content of the rare earth element or elements than in the Alloy I, addition of cobalt to the Alloy II has an effect of compensation for the increase in the oxidation susceptibility so as to contribute to the stabilization of the magnetic properties of the magnet obtained therefrom by preventing degradation due to oxidation. When gallium is contained as the element M in the Alloy II, gallium is concentrated at the grain boundaries even after sintering to exhibit an effect of increasing the coercive force of the sintered magnet.

The powders of the Alloys I and II prepared in the above described manner are mixed together in a specified weight proportion, i.e. in the range from 99:1 to 70:30 by weight, as uniformly as possible. This mixing process is also conducted in an atmosphere of an inert gas such as nitrogen in order to minimize oxidation of the particle surface. Instead of mixing the finely pulverized powders of the alloys each having an average particle diameter of 1 to 20 μm, it is optional that each of the alloys is first crushed into coarse particles and the coarse particles of the respective alloys are mixed together in a specified weight proportion followed by fine pulverization. The mixing proportion of the powder of the Alloy I to the powder of the Alloy II is in the range from 99:1 to 70:30 by weight or, preferably, in the range from 95:5 to 85:15 by weight. When the content of the Alloy II is too small, the density of the sintered magnet cannot be fully increased so as not to give a high coercive force of the magnet while, when the content thereof is too large, the nonmagnetic phases would have some predominance in the sintered body so that the saturation magnetic flux density of the magnet would be decreased.

The powder mixture of the Alloys I and II is then shaped into a green body of a desired form of the magnet by compression molding in a magnetic field. The direction of the magnetic field is usually perpendicular to the direction of compression but can be parallel. Quite satisfactory results of magnetization molding can be obtained in a magnetic field of 15 kOe and under a compression force of 1000 kgf/cm$^2$ though not particularly limitative thereto.

The green body of the powder mixture as compression-molded is subjected to sintering by heating in vacuum or in an atmosphere of an inert gas such as argon at a temperature in the range from 900° to 1200° C. for a length of time of at least 30 minutes. The sintered body is usually subjected to an aging treatment by heating at a temperature not exceeding 900° C. or, usually, in the range from 400° to 800° C. for 30 minutes or longer. Advantageously, the sintering process of the green body of the mixed powders is so efficient that the thus sintered body usually has a high density of at least 95% of the true density, i.e. the density of an alloy ingot having the same chemical composition as the average composition of the mixed powders, so as to exhibit a high residual magnetic flux density.

In the following, the method of the invention for the preparation of a rare earth-based permanent magnet is described in more detail by way of inventive examples and comparative examples making comparison between the two-alloy method and the single-alloy method. Namely, two Alloys I and II were prepared in each of the inventive examples and these alloys were processed in a weight ratio of 85:15 to 95:5 into a sintered permanent magnet in the above described manner while the permanent magnet in the comparative example having the same number as the inventive example was prepared from a single alloy ingot having the same chemical composition as the weighted average of the Alloys I and II in the corresponding inventive example.

Inventive Example 1 and Comparative Example 1

An ingot of an alloy, referred to as the Alloy I-1 hereinbelow, having a composition of the formula 12.5Nd-6.0B-81.5Fe in the atomic proportion, was prepared in Inventive Example 1 by melting together neodymium metal and iron metal each having a purity of at least 99.9% by weight and a ferroboron containing about 20% by weight of boron, the balance being iron, each in a calculated and weighed amount to give a composition of the above given formula under an atmosphere of argon in a high-frequency induction furnace followed by casting of the melt into a casting mold in which the melt was solidified by cooling at a cooling rate of 10° C. per minute. The ingot was subjected to a solution treatment by heating at 1070° C. for 20 hours under an atmosphere of argon.

Separately, an ingot of another alloy, referred to as the Alloy II-1 hereinbelow, was prepared in substantially the same manner as above from metals of neodymium, dysprosium, iron, gallium and cobalt each having a purity of at least 99.9% by weight and a ferroboron each in a calculated and weighed amount corresponding to the composition of the formula 20.0Nd-10.0Dy-20.0Fe-6.0B-4.0Ga-40.0Co.

The Alloys I-1 and II-1 were separately pulverized in an atmosphere of nitrogen each into a coarse powder having a particle size to pass a 30 mesh screen and these coarse powders of the Alloy I-1 and Alloy II-1 were taken and blended in a weight proportion of 90:10 taking 30 minutes in a V-mixer filled after replacement of air inside with nitrogen. The powder blend was then finely pulverized in a jet mill using high-pressure nitrogen as the jet gas into a fine powder mixture having an average particle diameter of about 5 μm.

A metal mold was filled with the fine powder mixture obtained above, which was brought in a magnetic field of 15 kOe to effect magnetic orientation of the particles and compression-molded under a compressive pressure of about 1000 kgf/cm$^2$ into a shaped green body. This green body was subjected to sintering by heating at 1070° C. for 1 hour under an atmosphere of argon in a sintering furnace followed by an aging treatment by keeping for 1 hour at a temperature of 530° C. into a sintered permanent magnet, which is referred to as the Magnet 1*a* hereinbelow.

In Comparative Example 1, an ingot of a further alloy, referred to as the Alloy III-1, was prepared in substantially the same manner as above from the same lots of the metals of neodymium, dysprosium, iron, gallium and cobalt and ferroboron each taken in an amount corresponding to the composition of the formula 13.1Nd-0.8Dy-3.2Co-6.0B-0.3Ga-76.6Fe in the atomic percentage, which was equivalent to the weighted average of the two formulas 12.5Nd-6.0B-81.5Fe for the Alloy I-1 and 20.0Nd-10.0Dy-20.0Fe-6.0B-4.0Ga-40.0Co for the Alloy II-1 combined in a weight proportion of 90:10. The ingot of the Alloy III-1 was pulverized into a fine powder in the same manner as in the pulverization of the Alloy I-1 and II-1 and the fine powder of the Alloy III-1 was processed singly into a permanent magnet, referred to as the Magnet 1*b* hereinbelow, in the same manner as above.

The Magnets 1*a* and 1*b* prepared above were subjected to the measurements of the density ρ in g/cm$^3$ and the magnetic properties including residual magnetic flux density Br in kG, coercive force iHc in kOe and maximum energy product (BH)max in MGOe to give the results shown in Tables 4 and 5, respectively, given below.

Inventive Examples 2 to 70 and Comparative Examples 2 to 70

The experimental procedure in each of Inventive Examples 2 to 70, in which Magnets 2*a* to 70*a*, respectively, were prepared, was substantially the same as in Inventive Example 1 described above except that the compositions of the two types of the alloys and/or mixing proportion of the alloys were different. Namely, the first magnetic alloy was selected from the Alloys I-1 to I-18 indicated in Table 1 below and the second magnetic alloy was selected from the Alloys II-1 to II-58 indicated in Table 2 below.

The experimental procedure in each of Comparative Examples 2 to 70, in which Magnets 2*b* to 70*b*, respectively, were prepared was substantially the same as in Comparative Example 1 described above except that each of the Magnets 2*b* to 70*b* was prepared from Alloys III-2 to III-70, respectively, while the composition of each of these alloys was the weighted average of the first-type alloy and the second-type alloy used in the Inventive Example having the same number. For example, the Alloy III-2 prepared and used in Comparative Example 2 for the Magnet 2*b* had a composition equivalent to the weighted average of the Alloy I-1 and Alloy II-2 prepared and used in Inventive Example 2 in a weight proportion of 90:10 for the Magnet 2*a*. The compositions of these Alloys III-2 to III-70 are shown in Table 3 below.

The Magnets 2*a* to 70*a* and 2*b* to 70*b* were each subjected to the measurements of the density and magnetic properties to give the results respectively shown in Table 4 below, which also shows the mixing ratio of the two types of the alloys by weight in Inventive Examples 2 to 70, and in Table 5 below.

TABLE 1

| Alloy No. | Atomic % | | | | | |
|---|---|---|---|---|---|---|
| | Nd | Pr | Dy | B | Co | Fe |
| I-1 | 12.5 | — | — | 6.0 | — | 81.5 |
| I-2 | 10.0 | 2.5 | — | 6.0 | — | 81.5 |
| I-3 | 12.5 | — | — | 6.0 | 1.5 | 80.0 |
| I-4 | 10.0 | 2.5 | — | 6.0 | 1.5 | 80.0 |
| I-5 | 10.0 | 2.5 | — | 6.0 | 5.0 | 76.5 |
| I-6 | 11.2 | 0.5 | 0.5 | 6.0 | 10.0 | 71.8 |
| I-7 | 12.0 | 0.5 | — | 6.0 | 20.0 | 61.5 |
| I-8 | 12.5 | — | — | 6.5 | 35.5 | 45.5 |
| I-9 | 12.0 | 0.5 | — | 6.0 | 5.0 | 76.5 |
| I-10 | 12.5 | — | — | 6.0 | 2.0 | 79.5 |
| I-11 | 12.5 | — | — | 6.0 | 3.0 | 78.5 |
| I-12 | 12.5 | — | — | 6.0 | 10.0 | 71.5 |
| I-13 | 10.0 | 2.0 | 0.5 | 6.0 | 5.0 | 76.5 |
| I-14 | — | 12.5 | — | 6.0 | — | 81.5 |
| I-15 | — | 12.5 | — | 6.0 | 3.0 | 78.5 |
| I-16 | — | 12.5 | — | 6.0 | 10.0 | 71.5 |
| I-17 | 2.5 | 10.0 | — | 6.0 | 15.0 | 66.5 |
| I-18 | 11.5 | — | 1.0 | 6.0 | 20.0 | 61.5 |

TABLE 2

| Alloy No. | Atomic % | | | | | | | |
|---|---|---|---|---|---|---|---|---|
| | Nd | Pr | Dy | B | Co | Fe | M.element | Tb |
| II-1 | 20.0 | — | 10.0 | 6.0 | 40.0 | 20.0 | 4.0 Ga | — |
| II-2 | 15.0 | — | 15.0 | 6.0 | 48.0 | 10.0 | 6.0 Ga | — |
| II-3 | 15.0 | — | 15.0 | 6.0 | 38.0 | 20.0 | 6.0 Ga | — |
| II-4 | 15.0 | — | 15.0 | 6.0 | 28.0 | 30.0 | 6.0 Ga | — |
| II-5 | 15.0 | — | 15.0 | 6.0 | 18.0 | 40.0 | 6.0 Ga | — |
| II-6 | 15.0 | — | 10.0 | 12.0 | 45.0 | 10.0 | 8.0 Ga | — |
| II-7 | 12.0 | — | 12.0 | 2.0 | 60.0 | 10.0 | 4.0 Ga | — |
| II-8 | 12.0 | 2.0 | 10.0 | 2.0 | 60.0 | 10.0 | 4.0 Ga | — |
| II-9 | 10.0 | — | 10.0 | 6.0 | 43.0 | 20.0 | 6.0 Ga | 5.0 |
| II-10 | 20.0 | — | 10.0 | 6.0 | 44.0 | 20.0 | — | — |
| II-11 | 15.0 | — | 15.0 | 6.0 | 54.0 | 10.0 | — | — |
| II-12 | 15.0 | — | 15.0 | 6.0 | 44.0 | 20.0 | — | — |
| II-13 | 15.0 | — | 15.0 | 6.0 | 34.0 | 30.0 | — | — |
| II-14 | 15.0 | — | 15.0 | 6.0 | 24.0 | 40.0 | — | — |
| II-15 | 15.0 | — | 10.0 | 12.0 | 43.0 | 20.0 | — | — |
| II-16 | 12.0 | — | 12.0 | 2.0 | 64.0 | 10.0 | — | — |
| II-17 | 12.0 | 2.0 | 10.0 | 2.0 | 64.0 | 10.0 | — | — |
| II-18 | 10.0 | — | 10.0 | 6.0 | 49.0 | 20.0 | — | 5.0 |
| II-19 | 15.0 | — | 15.0 | 6.0 | 50.0 | 10.0 | 4.0 Ga | — |
| II-20 | — | 20.0 | 10.0 | 6.0 | 40.0 | 20.0 | 4.0 Ga | |
| II-21 | 20.0 | — | 10.0 | 6.0 | 48.0 | 10.0 | 6.0 Ga | |
| II-22 | 10.0 | 10.0 | 10.0 | 6.0 | 48.0 | 10.0 | 6.0 Ga | |
| II-23 | 8.0 | 10.0 | 10.0 | 6.0 | 42.0 | 20.0 | 4.0 Ga | |
| II-24 | 10.0 | 8.0 | 10.0 | 6.0 | 40.0 | 20.0 | 6.0 Ga | |
| II-25 | 9.0 | 7.0 | 9.0 | 6.0 | 55.0 | 9.0 | 5.0 Ga | |
| II-26 | 10.0 | 5.0 | 10.0 | 12.0 | 44.0 | 15.0 | 4.0 Ga | |

TABLE 2-continued

| Alloy No. | Atomic % Nd | Pr | Dy | B | Co | Fe | M.element | Tb |
|---|---|---|---|---|---|---|---|---|
| II-27 | 5.0 | 10.0 | 10.0 | 2.0 | 45.0 | 20.0 | 8.0 Ga | |
| II-28 | 20.0 | — | 10.0 | 6.0 | 44.0 | 20.0 | — | |
| II-29 | 20.0 | — | 10.0 | 6.0 | 54.0 | 10.0 | — | |
| II-30 | 10.0 | 10.0 | 10.0 | 6.0 | 54.0 | 10.0 | — | |
| II-31 | 10.0 | 8.0 | 10.0 | 6.0 | 46.0 | 20.0 | — | |
| II-32 | 9.0 | 7.0 | 9.0 | 6.0 | 60.0 | 9.0 | — | |
| II-33 | 10.0 | 5.0 | 10.0 | 12.0 | 48.0 | 15.0 | — | |
| II-34 | 5.0 | 10.0 | 10.0 | 2.0 | 53.0 | 20.0 | — | |
| II-35 | 20.0 | — | 10.0 | 6.0 | 40.0 | 20.0 | 4.0 Al | |
| II-36 | 20.0 | — | 10.0 | 6.0 | 40.0 | 20.0 | 4.0 Cu | |
| II-37 | 20.0 | — | 10.0 | 6.0 | 40.0 | 20.0 | 4.0 Zn | |
| II-38 | 20.0 | — | 10.0 | 6.0 | 40.0 | 20.0 | 4.0 In | |
| II-39 | 20.0 | — | 10.0 | 6.0 | 40.0 | 20.0 | 4.0 Si | |
| II-40 | 20.0 | — | 10.0 | 6.0 | 42.0 | 20.0 | 2.0 P | |
| II-41 | 20.0 | — | 10.0 | 6.0 | 42.0 | 20.0 | 2.0 S | |
| II-42 | 20.0 | — | 10.0 | 6.0 | 40.0 | 20.0 | 4.0 Ti | |
| II-43 | 20.0 | — | 10.0 | 6.0 | 40.0 | 20.0 | 4.0 V | |
| II-44 | 20.0 | — | 10.0 | 6.0 | 40.0 | 20.0 | 4.0 Cr | |
| II-45 | 20.0 | — | 10.0 | 6.0 | 40.0 | 20.0 | 4.0 Mn | |
| II-46 | 10.0 | 10.0 | 10.0 | 6.0 | 40.0 | 20.0 | 4.0 Ge | |
| II-47 | 10.0 | 10.0 | 10.0 | 6.0 | 40.0 | 20.0 | 4.0 Zr | |
| II-48 | 10.0 | 10.0 | 10.0 | 6.0 | 40.0 | 20.0 | 4.0 Nb | |
| II-49 | 10.0 | 10.0 | 10.0 | 6.0 | 40.0 | 20.0 | 4.0 Mo | |
| II-50 | 10.0 | 10.0 | 10.0 | 6.0 | 40.0 | 20.0 | 4.0 Pd | |
| II-51 | 10.0 | 10.0 | 10.0 | 6.0 | 40.0 | 20.0 | 4.0 Ag | |
| II-52 | 10.0 | 10.0 | 10.0 | 6.0 | 40.0 | 20.0 | 4.0 Cd | |
| II-53 | 10.0 | 10.0 | 10.0 | 6.0 | 40.0 | 20.0 | 4.0 Sn | |
| II-54 | 10.0 | 10.0 | 10.0 | 6.0 | 40.0 | 20.0 | 4.0 Sb | |
| II-55 | 10.0 | 10.0 | 10.0 | 6.0 | 40.0 | 20.0 | 4.0 Hf | |
| II-56 | 10.0 | 10.0 | 10.0 | 6.0 | 40.0 | 20.0 | 4.0 Ta | |
| II-57 | 10.0 | 10.0 | 10.0 | 6.0 | 40.0 | 20.0 | 4.0 W | |
| II-58 | 10.0 | 10.0 | 10.0 | 6.0 | 38.0 | 20.0 | 4.0 Cr + 2.0 Si | |

TABLE 3

| Alloy No. | Atomic % Nd | Pr | Dy | B | Co | Fe | M.element | Tb |
|---|---|---|---|---|---|---|---|---|
| III-1 | 13.1 | — | 0.8 | 6.0 | 3.2 | 76.6 | 0.3 Ga | — |
| III-2 | 12.7 | — | 1.2 | 6.0 | 3.7 | 75.9 | 0.5 Ga | — |
| III-3 | 12.7 | — | 1.2 | 6.0 | 3.0 | 76.6 | 0.5 Ga | — |
| III-4 | 12.7 | — | 1.2 | 6.0 | 2.2 | 77.4 | 0.5 Ga | — |
| Ill-5 | 12.7 | — | 1.2 | 6.0 | 1.4 | 78.2 | 0.5 Ga | — |
| III-6 | 12.7 | — | 0.8 | 6.5 | 3.8 | 75.5 | 0.7 Ga | — |
| III-7 | 12.6 | — | 0.6 | 6.4 | 2.7 | 77.2 | 0.5 Ga | — |
| III-8 | 12.6 | — | 0.4 | 6.3 | 1.9 | 78.5 | 0.3 Ga | — |
| III-9 | 10.2 | 2.3 | 1.0 | 5.7 | 4.9 | 75.6 | 0.3 Ga | — |
| III-10 | 10.1 | 2.5 | 0.6 | 5.7 | 3.9 | 76.9 | 0.3 Ga | — |
| III-11 | 10.0 | 2.2 | 1.2 | 6.0 | 5.3 | 74.0 | 0.7 Ga | 0.6 |
| III-12 | 13.1 | — | 0.8 | 6.0 | 3.5 | 76.6 | — | — |
| III-13 | 12.7 | — | 1.2 | 6.0 | 4.2 | 75.9 | — | — |
| III-14 | 12.7 | — | 1.2 | 6.0 | 3.5 | 76.6 | — | — |
| III-15 | 12.7 | — | 1.2 | 6.0 | 2.7 | 77.4 | — | — |
| III-16 | 12.7 | — | 1.2 | 6.0 | 1.9 | 78.2 | — | — |
| III-17 | 12.7 | — | 0.8 | 6.5 | 3.7 | 76.3 | — | — |
| III-18 | 12.6 | — | 0.6 | 6.4 | 2.6 | 77.8 | — | — |
| III-19 | 12.6 | — | 0.4 | 6.3 | 1.8 | 78.9 | — | — |
| III-20 | 10.2 | 2.3 | 1.0 | 5.7 | 5.2 | 75.6 | — | — |
| III-21 | 10.1 | 2.5 | 0.7 | 5.7 | 4.2 | 76.8 | — | — |
| III-22 | 10.0 | 2.2 | 1.2 | 6.0 | 6.1 | 73.9 | — | 0.6 |
| III-23 | 13.1 | — | 0.8 | 6.0 | 4.5 | 75.3 | 0.3 Ga | — |
| III-24 | 12.7 | — | 1.2 | 6.0 | 5.3 | 74.5 | 0.3 Ga | — |
| III-25 | 10.8 | 2.3 | 0.8 | 6.0 | 4.5 | 75.3 | 0.3 Ga | — |
| III-26 | 9.4 | 3.6 | 0.6 | 6.0 | 3.9 | 76.2 | 0.3 Ga | — |
| III-27 | 10.8 | 2.3 | 0.8 | 6.0 | 8.4 | 71.2 | 0.5 Ga | — |
| III-28 | 3.1 | 10.0 | 0.8 | 6.0 | 8.4 | 71.2 | 0.5 Ga | — |
| III-29 | 11.1 | 1.1 | 1.3 | 6.0 | 12.6 | 67.6 | 0.3 Ga | — |
| III-30 | 11.8 | 1.1 | 0.8 | 6.0 | 21.6 | 58.2 | 0.5 Ga | — |
| III-31 | 12.2 | 0.6 | 0.8 | 6.5 | 37.1 | 42.4 | 0.4 Ga | — |
| III-32 | 11.8 | 0.9 | 0.9 | 6.5 | 8.3 | 71.3 | 0.3 Ga | — |
| III-33 | 11.9 | 0.8 | 0.6 | 6.4 | 7.3 | 72.8 | 0.2 Ga | — |
| III-34 | 11.9 | 0.8 | 0.8 | 5.7 | 5.5 | 74.7 | 0.6 Ga | — |
| III-35 | 13.1 | — | 0.8 | 6.0 | 4.5 | 75.6 | — | — |
| III-36 | 12.7 | — | 1.2 | 6.0 | 5.3 | 74.8 | — | — |
| III-37 | 10.8 | 2.3 | 0.8 | 6.0 | 4.5 | 75.6 | — | — |
| III-38 | 9.4 | 3.6 | 0.6 | 6.0 | 3.9 | 76.5 | — | — |
| III-39 | 10.8 | 2.3 | 0.8 | 6.0 | 8.4 | 71.7 | — | — |
| III-40 | 3.1 | 10.0 | 0.8 | 6.0 | 8.4 | 71.7 | — | — |

TABLE 3-continued

| Alloy No. | Atomic % Nd | Pr | Dy | B | Co | Fe | M.element | Tb |
|---|---|---|---|---|---|---|---|---|
| III-41 | 11.1 | 1.1 | 1.3 | 6.0 | 12.6 | 67.9 | — | — |
| III-42 | 11.8 | 1.1 | 0.8 | 6.0 | 21.6 | 58.7 | — | — |
| III-43 | 12.2 | 0.6 | 0.8 | 6.5 | 37.1 | 42.6 | — | — |
| III-44 | 11.8 | 0.9 | 0.9 | 6.5 | 8.3 | 71.6 | — | — |
| III-45 | 11.9 | 0.8 | 0.6 | 6.4 | 7.3 | 73.0 | — | — |
| III-46 | 11.9 | 0.8 | 0.8 | 5.7 | 5.5 | 75.3 | — | — |
| III-47 | 13.1 | — | 0.8 | 6.0 | 3.2 | 76.6 | 0.3 Al | — |
| III-48 | 13.1 | — | 0.8 | 5.9 | 5.9 | 74.0 | 0.3 Cu | — |
| III-49 | 13.1 | — | 0.8 | 6.0 | 12.4 | 67.4 | 0.3 Zn | — |
| III-50 | 10.8 | 2.3 | 0.8 | 6.0 | 3.1 | 76.7 | 0.5 In | — |
| III-51 | 10.8 | 2.3 | 0.8 | 6.0 | 7.8 | 72.0 | 0.3 Si | — |
| III-52 | 10.8 | 1.8 | 1.3 | 6.0 | 8.0 | 71.9 | 0.2 P | — |
| III-53 | 1.6 | 11.5 | 0.8 | 6.0 | 3.3 | 76.6 | 0.2 S | — |
| III-54 | 1.6 | 11.5 | 0.8 | 6.0 | 5.9 | 73.9 | 0.3 Ti | — |
| III-55 | 1.6 | 11.5 | 0.8 | 6.0 | 12.4 | 67.4 | 0.3 V | — |
| III-56 | 3.9 | 9.2 | 0.8 | 6.0 | 7.8 | 72.0 | 0.3 Cr | — |
| III-57 | 3.9 | 9.2 | 0.8 | 6.0 | 17.0 | 62.8 | 0.3 Mn | — |
| III-58 | 12.3 | 0.8 | 0.8 | 6.0 | 3.2 | 76.6 | 0.3 Ge | — |
| III-59 | 12.3 | 0.8 | 0.8 | 6.0 | 5.9 | 73.9 | 0.3 Zr | — |
| III-60 | 12.3 | 0.8 | 0.8 | 6.0 | 12.4 | 67.4 | 0.3 Nb | — |
| III-61 | 10.0 | 3.1 | 0.8 | 6.0 | 3.1 | 76.7 | 0.3 Mo | — |
| III-62 | 10.0 | 3.1 | 0.8 | 6.0 | 7.7 | 72.1 | 0.3 Pd | — |
| III-63 | 10.0 | 2.6 | 1.2 | 6.0 | 7.7 | 72.2 | 0.3 Ag | — |
| III-64 | 0.8 | 12.3 | 0.8 | 6.0 | 3.1 | 76.7 | 0.3 Cd | — |
| III-65 | 0.8 | 12.3 | 0.8 | 6.0 | 5.9 | 73.9 | 0.3 Sn | — |
| III-66 | 0.8 | 12.3 | 0.8 | 6.0 | 12.3 | 67.5 | 0.3 Sb | — |
| III-67 | 3.1 | 10.0 | 0.8 | 6.0 | 7.6 | 72.2 | 0.3 Hf | — |
| III-68 | 3.1 | 10.0 | 0.8 | 6.0 | 16.9 | 62.9 | 0.3 Ta | — |
| III-69 | 12.3 | 0.8 | 0.8 | 6.0 | 4.9 | 74.9 | 0.3 W | — |
| III-70 | 11.4 | 0.8 | 1.7 | 6.0 | 21.3 | 58.3 | 0.2 Si + 0.3 Cr | — |

TABLE 4

| Magnet No. | Alloi I: Alloy II (weight ratio) | Residual magnetic flux density, kG | Coercive force, kOe | Maximum energy product, MGOe | Density, g/cm$^3$ |
|---|---|---|---|---|---|
| 1a | I-1:II-1 (90:10) | 13.7 | 14.2 | 45.5 | 7.42 |
| 2a | I-1:II-2 (90:10) | 13.6 | 14.0 | 44.5 | 7.43 |
| 3a | I-1:II-3 (90:10) | 13.5 | 14.2 | 44.2 | 7.42 |
| 4a | I-1:II-4 (90:10) | 13.4 | 14.3 | 43.5 | 7.45 |
| 5a | I-1:II-5 (90:10) | 13.5 | 14.6 | 44.1 | 7.46 |
| 6a | I-1:II-6 (90:10) | 13.6 | 13.5 | 44.2 | 7.42 |
| 7a | I-1:II-6 (93:7) | 13.7 | 13.3 | 45.5 | 7.47 |
| 8a | I-1:II-6 (95:5) | 13.8 | 13.4 | 45.8 | 7.45 |
| 9a | I-2:II-7 (90:10) | 13.7 | 14.7 | 45.1 | 7.40 |
| 10a | I-2:II-8 (92:8) | 13.7 | 14.4 | 45.4 | 7.46 |
| 11a | I-2:II-9 (85:15) | 13.4 | 16.8 | 42.3 | 7.41 |
| 12a | I-1:II-10 (90:10) | 13.8 | 13.2 | 45.4 | 7.43 |
| 13a | I-1:II-11 (90:10) | 13.7 | 12.5 | 44.7 | 7.42 |
| 14a | I-1:II-12 (90:10) | 13.6 | 12.2 | 44.3 | 7.43 |
| 15a | I-1:II-13 (90:10) | 13.4 | 12.9 | 43.7 | 7.44 |
| 16a | I-1:II-14 (90:10) | 13.6 | 12.6 | 44.8 | 7.47 |
| 17a | I-1:II-15 (90:10) | 13.7 | 12.5 | 44.5 | 7.45 |
| 18a | I-1:II-15 (93:7) | 13.7 | 12.3 | 45.7 | 7.46 |
| 19a | I-1:II-15 (95:5) | 13.8 | 12.4 | 45.9 | 7.46 |
| 20a | I-2:II-16 (90:10) | 13.8 | 12.7 | 45.4 | 7.41 |
| 21a | I-2:II-17 (92:8) | 13.8 | 13.4 | 45.7 | 7.45 |
| 22a | I-2:II-18 (85:15) | 13.5 | 14.8 | 42.5 | 7.42 |
| 23a | I-3:II-1 (90:10) | 13.8 | 14.5 | 45.6 | 7.39 |
| 24a | I-3:II-19 (90:10) | 13.6 | 15.0 | 44.4 | 7.40 |
| 25a | I-4:II-1 (90:10) | 13.7 | 14.0 | 44.8 | 7.41 |
| 26a | I-4:II-20 (92:8) | 13.8 | 15.5 | 45.7 | 7.38 |
| 27a | I-5:II-21 (90:10) | 13.7 | 13.9 | 44.5 | 7.40 |
| 28a | I-5:II-22 (90:10) | 13.7 | 16.2 | 45.0 | 7.41 |
| 29a | I-6:II-23 (90:10) | 13.6 | 17.1 | 44.5 | 7.42 |
| 30a | I-7:II-24 (90:10) | 13.6 | 14.3 | 44.6 | 7.40 |
| 31a | I-8:II-25 (90:10) | 13.8 | 14.4 | 46.2 | 7.53 |
| 32a | I-9:II-26 (90:10) | 13.9 | 13.5 | 46.4 | 7.47 |
| 33a | I-9:II-26 (93:7) | 14.0 | 12.5 | 46.5 | 7.49 |
| 34a | I-10:II-27 (90:10) | 13.7 | 13.9 | 45.0 | 7.44 |
| 35a | I-3:II-1 (90:10) | 13.8 | 12.5 | 44.6 | 7.42 |
| 36a | I-3:II-2 (90:10) | 13.6 | 13.0 | 44.2 | 7.42 |
| 37a | I-4:II-28 (90:10) | 13.8 | 12.0 | 44.3 | 7.45 |
| 38a | I-4:II-28 (92:8) | 13.8 | 13.5 | 45.1 | 7.42 |
| 39a | I-5:II-29 (90:10) | 13.8 | 11.9 | 44.4 | 7.47 |
| 40a | I-5:II-30 (90:10) | 13.7 | 13.2 | 44.5 | 7.46 |

TABLE 4-continued

| Magnet No. | Alloi I: Alloy II (weight ratio) | Residual magnetic flux density, kG | Coercive force, kOe | Maximum energy product, MGOe | Density, g/cm$^3$ |
|---|---|---|---|---|---|
| 41a | I-6:II-31 (90:10) | 13.6 | 14.1 | 44.2 | 7.48 |
| 42a | I-7:II-31 (90:10) | 13.7 | 12.3 | 44.5 | 7.49 |
| 43a | I-8:II-32 (90:10) | 13.8 | 12.4 | 45.8 | 7.52 |
| 44a | I-9:II-33 (90:10) | 13.9 | 11.8 | 46.2 | 7.47 |
| 45a | I-9:II-33 (93:7) | 14.0 | 11.5 | 46.4 | 7.48 |
| 46a | I-10:II-34 (90:10) | 13.7 | 11.9 | 44.9 | 7.45 |
| 47a | I-1:II-35 (90:10) | 13.5 | 14.5 | 45.6 | 7.44 |
| 48a | I-11:II-36 (90:10) | 13.5 | 13.5 | 43.4 | 7.41 |
| 49a | I-12:II-37 (90:10) | 13.4 | 13.4 | 44.1 | 7.49 |
| 50a | I-2:II-38 (90:10) | 13.7 | 14.5 | 44.7 | 7.45 |
| 51a | I-5:II-39 (90:10) | 13.5 | 13.8 | 44.5 | 7.48 |
| 52a | I-13:II-40 (90:10) | 13.3 | 15.6 | 42.8 | 7.47 |
| 53a | I-14:II-41 (90:10) | 13.6 | 14.1 | 44.5 | 7.50 |
| 54a | I-15:II-42 (90:10) | 13.6 | 14.3 | 45.6 | 7.46 |
| 55a | I-16:II-43 (90:10) | 13.7 | 13.4 | 45.2 | 7.50 |
| 56a | I-5:II-44 (90:10) | 13.6 | 13.3 | 45.4 | 7.46 |
| 57a | I-17:II-45 (90:10) | 13.7 | 12.4 | 45.5 | 7.53 |
| 58a | I-1:II-46 (90:10) | 13.6 | 13.8 | 44.0 | 7.43 |
| 59a | I-11:II-47 (90:10) | 13.6 | 13.7 | 45.0 | 7.44 |
| 60a | I-12:II-48 (90:10) | 13.6 | 13.8 | 44.0 | 7.49 |
| 61a | I-2:II-49 (90:10) | 13.6 | 12.9 | 45.0 | 7.46 |
| 62a | I-5:II-50 (90:10) | 13.5 | 13.4 | 44.7 | 7.47 |
| 63a | I-13:II-51 (90:10) | 13.1 | 16.4 | 40.2 | 7.43 |
| 64a | I-14:II-52 (90:10) | 13.4 | 13.3 | 44.4 | 7.39 |
| 65a | I-15:II-53 (90:10) | 13.3 | 12.5 | 43.5 | 7.39 |
| 66a | I-16:II-54 (90:10) | 13.6 | 13.5 | 44.0 | 7.54 |
| 67a | I-5:II-55 (90:10) | 13.6 | 13.1 | 44.0 | 7.42 |
| 68a | I-17:II-56 (90:10) | 13.7 | 11.9 | 45.0 | 7.54 |
| 69a | I-10:II-57 (90:10) | 13.6 | 13.9 | 45.2 | 7.45 |
| 70a | I-18:II-58 (91:9) | 13.0 | 12.7 | 41.6 | 7.53 |

TABLE 5

| Magnet No. | Residual magnetic flux density, kG | Coercive force, kOe | Maximum energy product, MGOe | Density, g/cm$^3$ |
|---|---|---|---|---|
| 1b | 12.8 | 9.2 | 36.0 | 7.44 |
| 2b | 12.8 | 7.9 | 34.5 | 7.41 |
| 3b | 12.7 | 8.5 | 37.3 | 7.42 |
| 4b | 12.6 | 8.8 | 36.5 | 7.47 |
| 5b | 12.7 | 7.5 | 33.3 | 7.42 |
| 6b | 12.6 | 7.0 | 34.7 | 7.44 |
| 7b | 12.7 | 7.7 | 36.8 | 7.41 |
| 8b | 12.8 | 7.0 | 34.8 | 7.44 |
| 9b | 12.8 | 8.9 | 37.2 | 7.39 |
| 10b | 12.7 | 8.1 | 37.9 | 7.43 |
| 11b | 12.5 | 9.5 | 36.5 | 7.47 |
| 12b | 12.8 | 8.7 | 36.0 | 7.43 |
| 13b | 12.9 | 7.3 | 34.6 | 7.43 |
| 14b | 12.8 | 8.1 | 37.3 | 7.44 |
| 15b | 12.6 | 8.5 | 36.7 | 7.46 |
| 16b | 12.8 | 7.0 | 33.5 | 7.43 |
| 17b | 12.7 | 7.0 | 34.8 | 7.44 |
| 18b | 12.8 | 7.1 | 36.9 | 7.42 |
| 19b | 12.9 | 7.9 | 34.9 | 7.45 |
| 20b | 12.9 | 7.9 | 37.3 | 7.40 |
| 21b | 12.8 | 8.1 | 38.0 | 7.43 |
| 22b | 12.6 | 9.3 | 36.7 | 7.46 |
| 23b | 12.6 | 8.5 | 37.0 | 7.38 |
| 24b | 12.7 | 9.8 | 38.3 | 7.42 |
| 25b | 12.8 | 9.8 | 38.3 | 7.40 |
| 26b | 12.8 | 8.7 | 35.5 | 7.39 |
| 27b | 12.5 | 9.2 | 36.5 | 7.42 |
| 28b | 12.4 | 7.2 | 36.5 | 7.37 |
| 29b | 12.7 | 9.3 | 33.8 | 7.37 |
| 30b | 12.6 | 7.4 | 34.9 | 7.41 |
| 31b | 12.7 | 8.8 | 36.8 | 7.50 |
| 32b | 12.6 | 9.0 | 37.2 | 7.49 |
| 33b | 12.9 | 7.0 | 38.8 | 7.47 |
| 34b | 12.8 | 8.5 | 37.8 | 7.42 |
| 35b | 12.6 | 8.1 | 36.5 | 7.44 |
| 36b | 12.8 | 9.1 | 38.0 | 7.41 |
| 37b | 12.8 | 8.8 | 37.3 | 7.41 |
| 38b | 12.8 | 7.7 | 34.5 | 7.43 |
| 39b | 12.6 | 8.2 | 35.6 | 7.44 |
| 40b | 12.5 | 7.2 | 36.6 | 7.47 |

TABLE 5-continued

| Magnet No. | Residual magnetic flux density, kG | Coercive force, kOe | Maximum energy product, MGOe | Density, g/cm$^3$ |
|---|---|---|---|---|
| 41b | 12.7 | 8.8 | 33.9 | 7.49 |
| 42b | 12.7 | 7.4 | 35.9 | 7.48 |
| 43b | 12.7 | 8.7 | 36.7 | 7.50 |
| 44b | 12.7 | 8.4 | 37.12 | 7.49 |
| 45b | 12.9 | 7.5 | 38.9 | 7.46 |
| 46b | 12.8 | 8.1 | 37.8 | 7.42 |
| 47b | 12.6 | 8.4 | 36.9 | 7.42 |
| 48b | 12.7 | 9.6 | 38.6 | 7.43 |
| 49b | 12.7 | 9.2 | 37.3 | 7.47 |
| 50b | 12.6 | 8.3 | 35.5 | 7.39 |
| 51b | 12.5 | 9.6 | 36.25 | 7.39 |
| 52b | 12.4 | 7.0 | 35.5 | 7.42 |
| 53b | 12.2 | 3.9 | 13.8 | 7.27 |
| 54b | 12.4 | 4.7 | 31.9 | 7.35 |
| 55b | 12.6 | 7.8 | 34.8 | 7.45 |
| 56b | 12.5 | 8.0 | 35.2 | 7.48 |
| 57b | 12.6 | 7.0 | 28.8 | 7.51 |
| 58b | 12.4 | 7.5 | 24.8 | 7.41 |
| 59b | 12.4 | 8.5 | 35.8 | 7.42 |
| 60b | 12.7 | 8.5 | 36.8 | 7.47 |
| 61b | 12.6 | 8.1 | 35.8 | 7.42 |
| 62b | 12.7 | 8.3 | 36.8 | 7.46 |
| 63b | 12.6 | 8.7 | 35.8 | 7.40 |
| 64b | 12.3 | 9.0 | 33.2 | 7.34 |
| 65b | 12.1 | 7.9 | 32.8 | 7.37 |
| 66b | 12.5 | 8.5 | 33.8 | 7.52 |
| 67b | 12.2 | 8.3 | 34.5 | 7.43 |
| 68b | 12.8 | 8.5 | 32.3 | 7.52 |
| 69b | 12.4 | 9.5 | 36.1 | 7.42 |
| 70b | 12.1 | 8.5 | 30.7 | 7.52 |

What is claimed is:

1. A method for the preparation of a rare earth-based permanent magnet which comprises the steps of:

(a1) melting together, at a temperature of 1000° C. or higher in an inert atmosphere, a rare earth metal, metallic iron or a combination of metallic iron and metallic cobalt and elementary boron in such a proportion represented by the formula $$R_2T_{14}B,$$

in which R is a rare earth element and T is iron or a combination of iron and cobalt in such a proportion that the amount of cobalt does not exceed 40% by weight of the total amount of iron and cobalt to form a melt of a first magnetic alloy;

(b1) cooling the melt of the first magnetic alloy in a casting mold at a rate of temperature decrease not exceeding 850° C. per minute but not lower than 1° C. per minute at least until the temperature of the melt reaches 200° C. to form an ingot of the first magnetic alloy;

(a2) melting together, at a temperature of 1000° C. or higher in an inert atmosphere, a rare earth element, iron and cobalt, elementary boron and the elementary form of an element M defined below in such a proportion represented by the formula $$R_aFe_bCo_cB_dM_e,$$

in which R has the same meaning as defined above, M is an element selected from the group consisting of gallium, aluminum, copper, zinc, indium, silicon, phosphorus, sulfur, titanium, vanadium, chromium, manganese, germanium, zirconium, niobium, molybdenum, palladium, silver, cadmium, tin, antimony, hafnium, tantalum and tungsten, the subscript a is a positive number in the range from 15 to 40, b is zero or a positive number not exceeding 80, c is a positive number in the range from 5 to 85, d is a positive number not exceeding 20 and e is zero or a positive number not exceeding 20 with the proviso that a+b+c+d+e is 100 to form a melt of a second magnetic alloy;

(b2) cooling the melt of the second magnetic alloy in a casting mold at a rate of temperature decrease not exceeding 850° C. per minute at least until the temperature of the melt reaches 200° C. to form an ingot of the second magnetic alloy;

(c) crushing and pulverizing the ingots of the first and second magnetic alloys either together or separately in an inert atmosphere into particles having an average particle diameter in the range from 1 to 20 μm;

(d) uniformly mixing the particles of the first and second magnetic alloys in a weight proportion in the range from 99:1 to 70:30 in an inert atmosphere to form a powder mixture;

(e) shaping the powder mixture into a powder compact having a form of a magnet by compression molding in a magnetic field;

(f) sintering the shaped form of the powder compact by heating in vacuum or in an atmosphere of an inert gas at a temperature in the range from 900° C. to 1250° C. for a length of time in the range from 30 minutes to 10 hours; and (g) subjecting the sintered body to an aging treatment at a temperature not exceeding 900° C. for at least 30 minutes.

2. The method for the preparation of a rare earth-based permanent magnet as claimed in claim 1 in which the element denoted by M is gallium.

3. The method for the preparation of a rare earth-based permanent magnet as claimed in claim 1 in which the element denoted by R is a rare earth element selected from the group consisting of neodymium, praseodymium, dysprosium and terbium.

4. The method for the preparation of a rare earth-based permanent magnet as claimed in claim 3 in which the element denoted by R is neodymium.

5. The method for the preparation of a rare earth-based permanent magnet as claimed in claim 1 in which the subscript a is a positive number in the range from 25 to 35, b is a positive number in the range from 5 to 45, c is a positive number in the range from 15 to 65, d is a positive number in the range from 1 to 15 and e is zero or a positive number not exceeding 10 with the proviso that a+b+c+d+e is 100.

6. The method for the preparation of a rare earth-based permanent magnet as claimed in claim 1 in which the second magnetic alloy has a metallographic structure comprising the phase of $R_2T_{14}B$ and at least one of the phases expressed by the formulas $RT_4L$, $RT_3$, $RT_2$, $R_2T_7$ and $RT_5$, in which R and T each have the same meaning as defined above and L is boron or a combination of boron and the element M.

* * * * *